US010919662B2

(12) United States Patent
Maldonado Barragan

(10) Patent No.: US 10,919,662 B2
(45) Date of Patent: Feb. 16, 2021

(54) LIQUID CONTAINER

(71) Applicant: Jose Antonio Maldonado Barragan, Sonora (MX)

(72) Inventor: Jose Antonio Maldonado Barragan, Sonora (MX)

( * ) Notice: Subject to any disclaimer, the term of this patent is extended or adjusted under 35 U.S.C. 154(b) by 70 days.

(21) Appl. No.: 16/432,740

(22) Filed: Jun. 5, 2019

(65) Prior Publication Data

US 2019/0283920 A1 Sep. 19, 2019

Related U.S. Application Data

(63) Continuation of application No. 15/724,852, filed on Oct. 4, 2017, now abandoned.

(51) Int. Cl.

| | |
|---|---|
| ***B65D 3/06*** | (2006.01) |
| ***B65D 3/08*** | (2006.01) |
| ***B65D 3/20*** | (2006.01) |
| ***B65D 5/40*** | (2006.01) |
| ***B65D 3/22*** | (2006.01) |
| ***B65D 81/38*** | (2006.01) |
| ***B65D 1/26*** | (2006.01) |

(52) U.S. Cl.

CPC ..... *B65D 3/20* (2013.01); *B65D 1/265* (2013.01); *B65D 3/06* (2013.01); *B65D 81/3869* (2013.01); *B65D 3/08* (2013.01); *B65D 3/22* (2013.01); *B65D 5/40* (2013.01)

(58) Field of Classification Search

CPC .. B65D 81/3865; B65D 81/3869; B65D 3/06; B65D 3/08; B65D 3/20; B65D 3/22; B65D 1/265; B65D 5/40; B65D 5/0209; B65D 5/74; A47G 19/2205

See application file for complete search history.

(56) References Cited

U.S. PATENT DOCUMENTS

| | | | | | |
|---|---|---|---|---|---|
| 2,047,804 | A | * | 7/1936 | Shapiro | B65D 5/06 229/138 |
| 2,091,291 | A | * | 8/1937 | Ringler | B65D 5/06 229/109 |
| 3,232,480 | A | * | 2/1966 | Stanley | A47F 1/085 221/305 |
| 3,253,767 | A | * | 5/1966 | Pellaton | B65D 5/06 229/109 |
| 3,549,081 | A | * | 12/1970 | Nelson | B65D 5/60 229/117 |
| 3,768,720 | A | * | 10/1973 | Bundy | B65D 5/48024 229/117.25 |

(Continued)

*Primary Examiner* — Justin M Larson
(74) *Attorney, Agent, or Firm* — Jason Jones

(57) ABSTRACT

A solution for a logistical problem within the beverage industry, specifically related to hot beverages such as coffee and tea; namely, storing the means to sell the beverages, which generally includes a cup, a lid for the cup, and an insulation sleeve that allows holding the cup in a comfortable way for the consumer, avoiding burns due to the high temperatures of the liquid. Thus, the container presented here unifies the 3 elements, comprising a body formed by a base and a wall, where the upper edge of said container has a group of flaps that in their closed position enables liquid containment and prevents spillage in case the container is moved, and through a modification in the cross profile of the wall. Additionally, the container has an insulation sleeve that keeps the contact surface at a low temperature.

22 Claims, 5 Drawing Sheets

(56) References Cited

U.S. PATENT DOCUMENTS

D317,262 S * 6/1991 Bluff ..... D9/431
D325,168 S * 4/1992 Dlabac ..... 229/120.03
5,358,175 A * 10/1994 Cai ..... B65D 3/08 229/104
D358,092 S * 5/1995 Cai ..... D9/433
5,558,272 A * 9/1996 Magister ..... B65D 5/06 229/109
5,676,306 A * 10/1997 Lankin ..... B65D 3/20 229/138
D387,984 S * 12/1997 Magister ..... D9/430
6,019,277 A * 2/2000 Lundstrom ..... B65D 5/06 229/103.1
6,523,306 B1 * 2/2003 Gordon-Clements ..... A01G 24/28 47/73
6,955,289 B2 * 10/2005 Green ..... B65D 3/20 229/125.17
D524,647 S * 7/2006 Ellman ..... D9/433
D534,424 S * 1/2007 Ellman ..... D9/430
D588,453 S * 3/2009 Glade ..... D9/430
D589,344 S * 3/2009 Lang ..... D9/431
D589,345 S * 3/2009 Lang ..... D9/431
7,681,784 B2 * 3/2010 Lang ..... B65D 3/20 229/138
D616,300 S * 5/2010 Shaikh ..... D9/430
D616,301 S * 5/2010 Stephens ..... D9/430
D617,183 S * 6/2010 Stephens ..... D9/430
7,726,551 B2 * 6/2010 Abbott ..... B65D 3/06 229/404
D620,792 S * 8/2010 Shaikh ..... D9/430
D620,793 S * 8/2010 Stephens ..... D9/430
8,066,175 B2 * 11/2011 Nieto ..... B65D 5/10 229/109
8,162,205 B2 * 4/2012 Stephens ..... B65D 5/10 229/110
D707,353 S * 6/2014 Carr ..... D24/123
8,763,887 B2 * 7/2014 Nieto ..... B65D 5/029 229/109
9,434,504 B2 * 9/2016 Fisher ..... B65D 5/68
9,511,197 B2 * 12/2016 Hetzel ..... A61M 13/00
9,617,053 B2 * 4/2017 Fisher ..... B65B 9/2056
10,450,100 B2 * 10/2019 Caliri ..... B65D 3/26
D889,205 S * 7/2020 Said ..... D7/523

* cited by examiner

LIQUID CONTAINER

PRIORITY CLAIM

This application is a continuation of U.S. patent application Ser. No. 15/724,852, filed on Oct. 4, 2017, which claims the benefit of Mexican Patent Application Serial No. MX/a/2017/008789, filed Jun. 30, 2017, which is hereby incorporated herein by reference in its entirety.

DESCRIPTION

Field of the Invention

As mentioned in the title of this descriptive report, this invention refers to a liquid container. Specifically, it is a cup-shaped container that can hold liquids without spilling. The structure of the cup is comprised of a group of flaps that securely close just enough to prevent spilling while at the same time leaving an opening to allow pouring the stored liquid.

Background of the Invention

In the beverage sales industry, the disposable cup is one of the most used products to serve hot beverages to consumers since it allows delivering such products in a good-quality container that can be disposed when the beverage is finished. In this segment, many types of cups of varying materials have been designed in order to adapt to the needs of consumers as well as the types of the beverages contained in them. Examples of cups featuring thermal isolation (designed to contain hot beverages) come in many different forms: polystyrene, paper, paperboard, etc. Specifically in the case of hot beverages, there are different solutions to isolate the cup even more; for example, paperboard sleeves placed at a given height outside the cup prevent the consumer from being affected by the high temperature of the cup's contents.

Additionally, multiple types of lids have been devised using different materials with the objective to provide a closed cup that prevents liquid from spilling over while moving and at the same time allows drinking the contents at any given time. These adjustments meet the needs of the cup user and are based on his or her activities while carrying the cup and drinking while moving about different places.

Lids, paperboard sleeves, and cups present a logistic problem for the seller of hot beverages since, in general, they are delivered separately even if the same company manufactures all three products. That's to say that when the seller of hot beverages is provided with lids, sleeves, and cups appropriate for the selling of their product, they need to have at least one type of box for each of the components, thus requiring more physical space and inventory control work, in addition to a process design so the operators in charge of assembling the components and the aforementioned activities can do it the best way possible.

Taking into account the problem presented in the former paragraph, this state-of-the-art situation reveals several solutions, two of which are described below:

Document US20150097026 presents a cup with a pair of flaps that close the upper part as a double roof. On the closing corners of the flaps, the cup has a fin arrangement that ensures closing of said flaps.

Document EP2653401 describes a container composed of a flexible laminated material that forms two flaps that run from the base and that form a pair of channels that allow pouring the liquid when closing them, specifically a pair of elevated channels to drink the liquid content.

Despite that both documents provide a possible solution to avoid spillage, these do not take into account the heating of the cup due to the high temperature of hot beverages contained inside the cup. Additionally, the closing of the flaps in both containers is ensured in order to prevent spontaneous opening due to the movement of the cup while in transit.

DETAILED DESCRIPTION OF THE INVENTION

Figure 1:
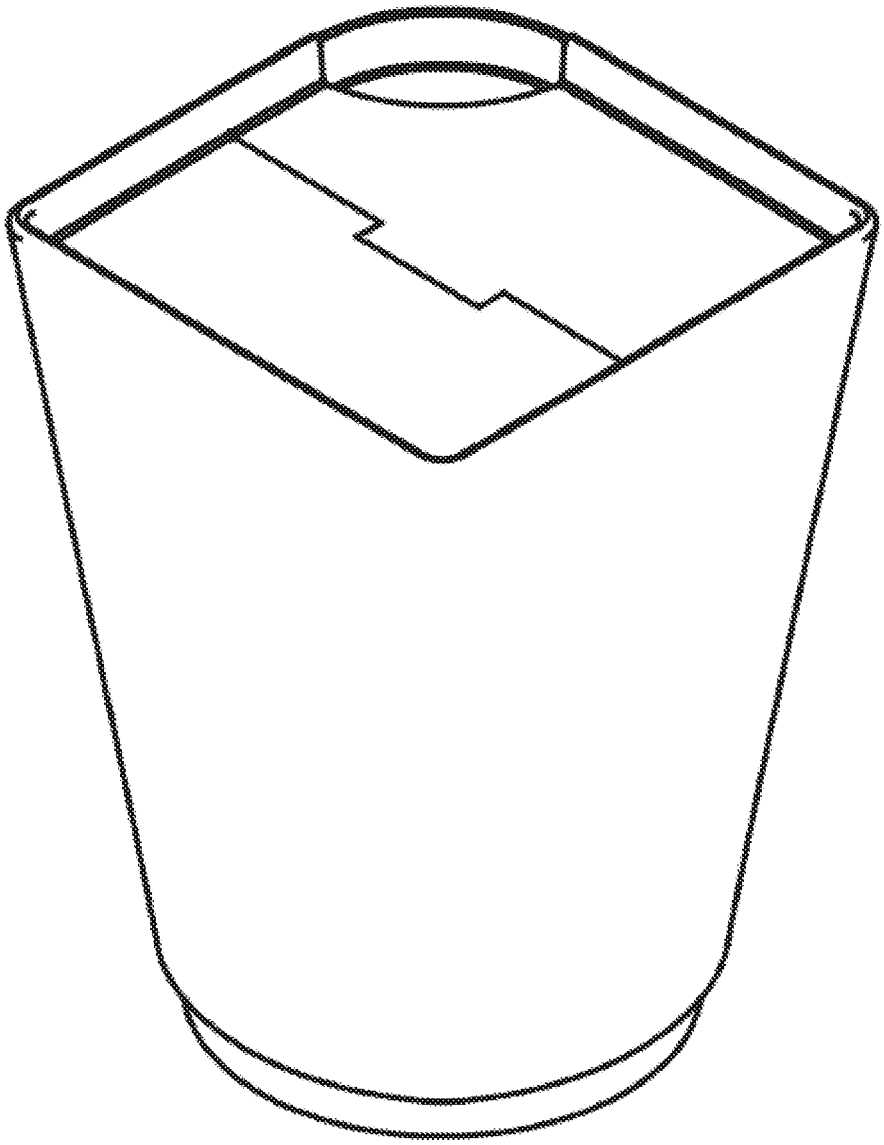
FIG. 1. Isometric view of the cup with the flaps closed.
Figure 2:
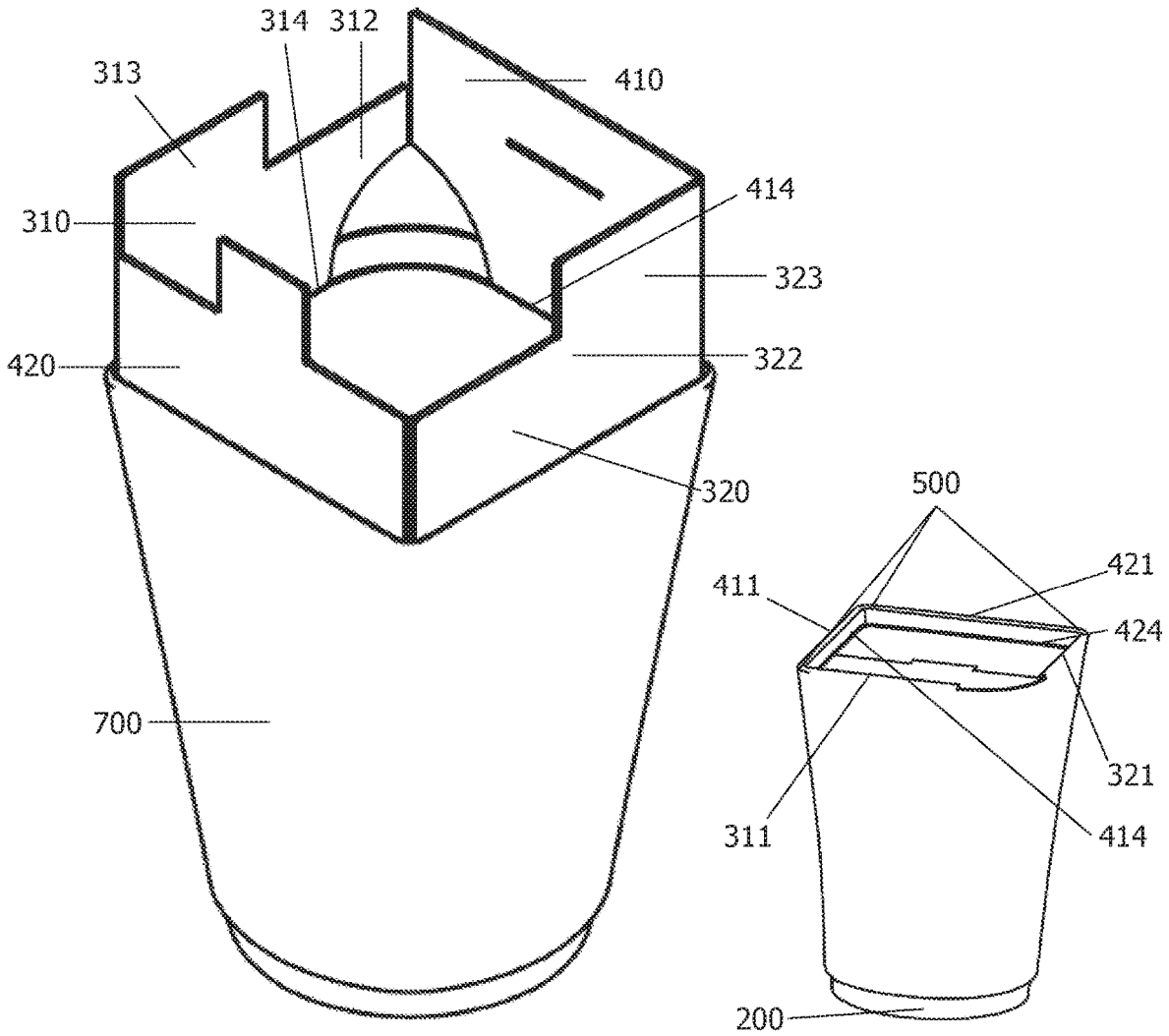
FIG. 2. Isometric view of the cup with the flaps open, with detail of the cup with the flaps closed pointing out the sealing points.
Figure 3:
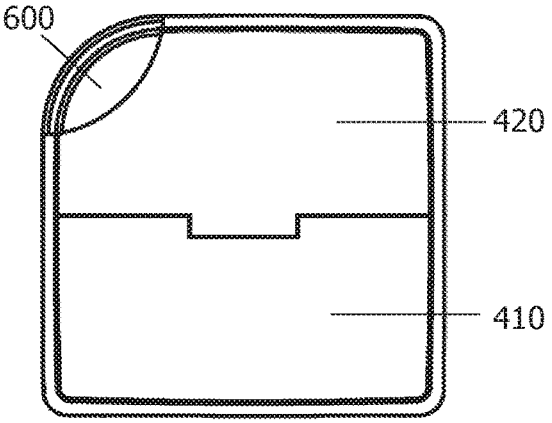
FIG. 3. Upper view of the cup with the flaps closed.
Figure 4:
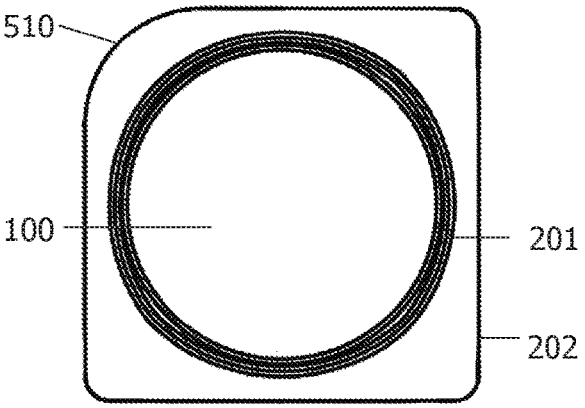
FIG. 4. Lower view of the cup with the flaps closed.
Figure 6:
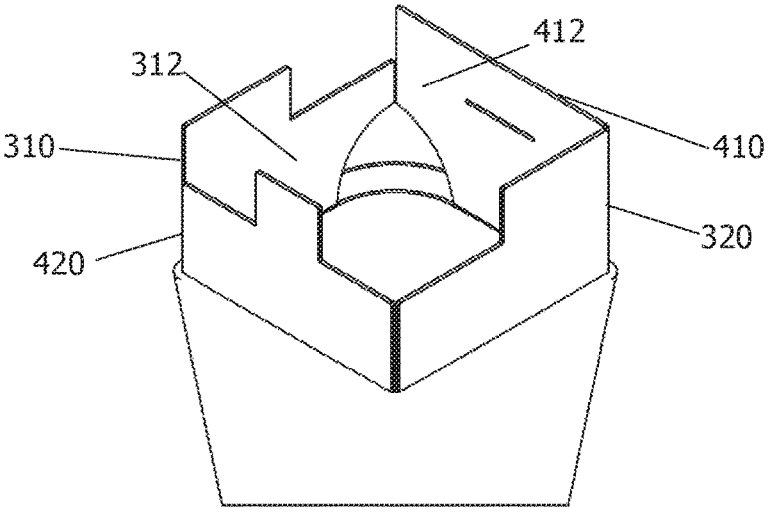
FIG. 6. Isometric view of the cup with a close-up of the flaps open, including details of the sealing bend.
Figure 5:
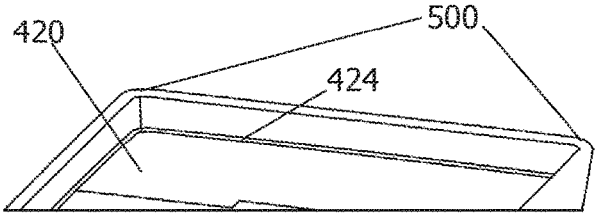
FIG. 5. Isometric, close-up view of the cup with the flaps closed, including details of the sealing bend.
Figure 7:
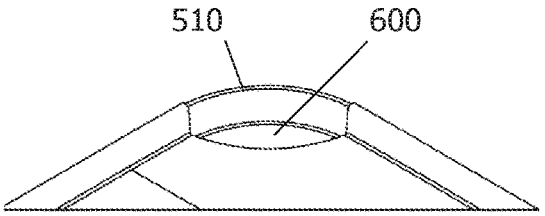
FIG. 7. Isometric close-up view of one corner of the cup, including details of the opening to empty the cup.
Figure 8:
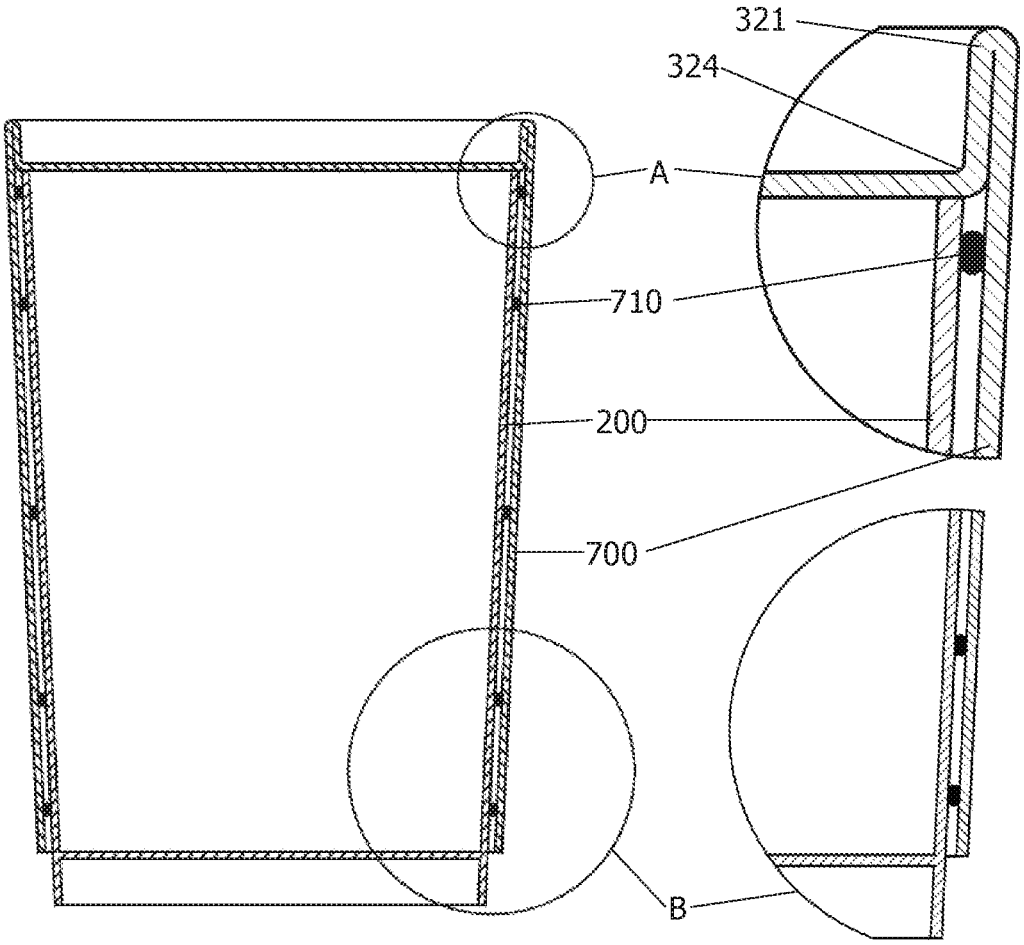
FIG. 8. Side view of the cup with crosscut, including details of the layer structure that allows insulation.
Figure 9:
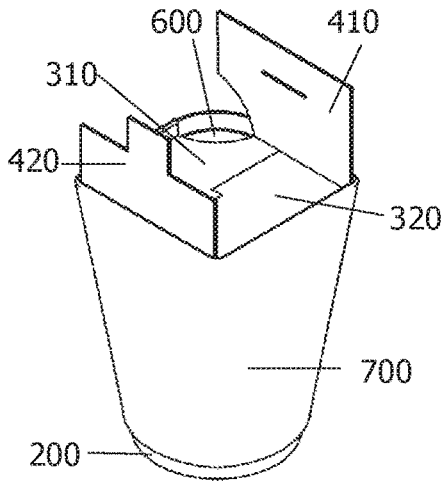
FIG. 9. Upper view of the cup with both internal flaps closed and the external flaps open.

In view of the above, an invention was developed which attempts to provide the consumer a reliable container to carry hot beverages, where liquid spillage is prevented while the thermal insulation is maintained to provide more comfort. Additionally, the logistical problem originated by the current group of elements to reach the first objective is solved, since the invention described herein reduces the entire product to one element only, requiring only one storage type and inventory work associated with only one component.

The invention described in this descriptive report is comprised of a drink container, specifically a container whose particular characteristics allow it to partially prevent spillage of the liquid stored inside the container, when said container is subject to vibration while in transit.

The container includes a base (100), a continuous wall (200), a group of internal flaps (310, 320), and a group of external flaps (410, 420). In turn, the union of the wall (200) with the internal flaps (310, 320) and the external ones (410, 420) allows for the formation of a group of sealing points (500) and a single opening (600), which allows pouring the liquid that is inside the container.

The base (100) is comprised of a horizontal surface that forms the lower support of the container, and its edges are joined to the wall (200) to form the container's main body.

The wall (200) includes a continuous surface that surrounds the base (100) and is perpendicularly joined to the edges of the base, where the joint angle may be equal or greater than 90° inclination to the horizontal alignment of the base (100).

The wall (200) is configured in such a way that the joint at the base (100) occurs circularly; that is, the profile of the joint between the base and the wall features a cylindrical profile (201) in the same way as occurs in a cup with the traditional cylindrical profile. As the height of the wall continues up the profile, this modifies its geometry to end in the upper edge of the wall with a polygonal profile (202). Hence, the stability and resistance of a traditional circular base cup are kept thus generating the same type of necessary configuration to place a group of flaps in its upper portion which allow for the container's partial closing.

Figure 10:
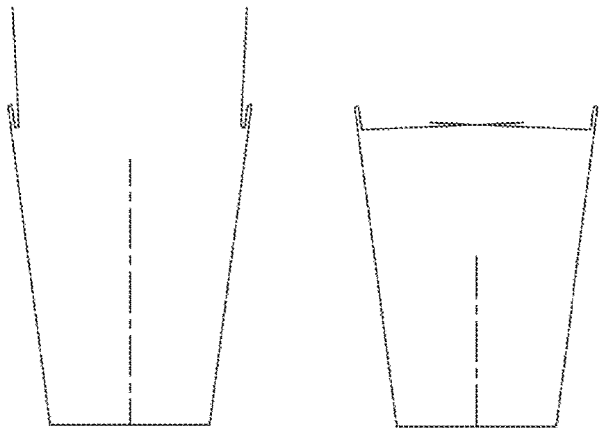
FIG. 10. Side view of the cup with crosscut, including details of a possible closure by overlapping the flaps.
Figure 11:
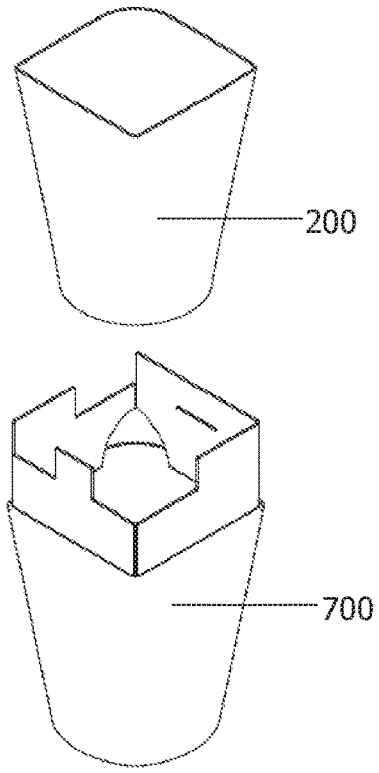
FIG. 11. Isometric view focused on the cup assembly within the isolation sleeve, where the flaps are built into the insulation sleeve.

A first group of flaps (310, 320) presents a configuration enables fast closure, where several arrangements are possible such as a simple overlap of one flap on another flap (FIG. 10); a partial overlap between protruding sections of both flaps; a partial overlap between toothed portions of both flaps. These configurations are mentioned as examples without limiting in any way the type of closure between the first group of flaps.

A second group of flaps (410, 420) reveals a configuration that also enables fast closure along with means that ensure it remains in the closed position even during movement of the container. Several arrangements are possible such as when the first flap features a tab that is introduced in the slot of the second flap. This configuration is mentioned as an example without limiting in any way the type of closure between the second group of flaps.

All flaps have bends that ensure the closure of the sealing points (500) as well as overlapping of the flap edges that are joined to the upper edge of the cup, thus creating a seal that prevents spillage of the cup's contents. The geometry of the bends affects the geometry of the flaps, making them longer in order to get an optimal overlap for sealing. Each flap includes a bend (314, 324, 414, 424) positioned a short distance from the edge (311, 321, 411, 421) in such a way that each flap keeps its position in the upper part of the cup, while it forms a step between the upper part of the cup and the horizontal part formed by the surface (312, 322, 412, 422) that covers the mouth of the container.

In one of the vertices of the polygonal profile in the upper edge of the cup a cut is made in the surface (312) of one of the internal flaps and a cut consistent with the first cut on the surface (412) of one of the external flaps. When the cut flaps (310, 410) are closed along with its corresponding flaps (320, 420), both cuts create an opening (600), the function of which allows the consumer to pour the liquid into his or her mouth or in another container, facilitating the pouring of the container's contents without opening the flaps.

Exemplary Embodiment(S) of the Invention

In one embodiment of the invention, the polygonal upper profile of the container wall is a regular polygon with an even number of sides. Specifically, the polygonal profile has rectangular form, particularly that of a square.

In another embodiment of the invention, particularly related to the square geometry, one of the vertices (510) is slightly rounded, concurring with the opening, to enable using the container as a cup in such a way that the action of drinking will be more comfortable for the consumer.

In yet another embodiment of the invention, the upper edge of the container features a pair of flaps (310, 320) joined at opposite ends in such a way that the closing of the flaps enables the container mouth to be covered. Additionally, a second pair of flaps (410, 420) are overlapped with the internal pair of flaps (310, 320) when closed. These are joined to the upper edge of the container at opposite ends and alternate to the internal pair of flaps.

Each one of the internal flaps (310, 320) possesses a specific configuration enabling the closure to prevent spilling the cup's contents. The basic configuration of the first internal flap (310) is comprised of a first edge (311) joined to the upper edge of the container, where there is a surface (312) that extends to the center, covering half of the mouth of the container. From that surface (312), an additional portion extends (313) with a width equal to half the width of the first edge (311) with enough length to enable overlapping of the two flaps thus keeping them in a horizontal position, avoiding the formation of any other opening foreign to the opening for pouring (600). The basic configuration of the second internal flap (320) will be similar to the first internal flap (310), with a first edge (321) joined to the upper edge of the container, a surface (322) extended toward the center and covering half the mouth of the container including an additional portion (323) with a width equal to half the width of the first edge (321) with enough length that enables overlapping and keeps them in a horizontal position, preventing the formation of any opening foreign to the opening for pouring (600).

Still another embodiment of the invention features the external flaps (410, 420) closing by means of a tab and slot, where a tab (425) protrudes from the surface (422) formed by one of the flaps (420). The form and dimensions of the tab correspond to the form and dimensions of the slot (415) made in the surface (412) of the opposite flap (410). Therefore, the tab (425) can be introduced in the slot (415), ensuring the closed position of the flaps.

In one other approach of the invention, the container is comprised of a structure formed by the base (100), the wall (200), and the groups of flaps (310, 320, 410, 420) joined to the wall which produce the sealing points (500) and the opening for pouring (600).

In an additional embodiment of the invention, the container includes an insulation layer joined to the wall (200). This insulation layer is comprised of a sleeve (700) that wraps around the cup parallel to the wall and imitates the circular profile (201) of the base (100), becoming a polygonal profile as it reaches the upper edge (202). The sleeve is joined to the wall of the container with glue (710), which, due to its volume and specific application, leaves gaps of air (711) between the wall (200) and the sleeve (700). The application of the glue can be made using any pattern, provided that enough gaps are left to contain air between the wall and the sleeve. This double layer of material formed by the wall (200) and the sleeve (700) with air in the middle due to the gaps created by the glue (710), obtains effective thermal insulation of the hot beverage for the consumer.

In another embodiment of the invention, the flaps are joined to the upper edge (701) of the sleeve (700) instead of being joined to the upper edge (202) of the wall (200).

I claim:

1. A liquid container, comprising:

a base;

a wall joined to the base; and several flaps joined to the upper edge of the container in such a way that when they close, the mouth of the container formed by the base and the wall is covered;

characterized in that the wall joined to the base has a circular profile in its lower edge which modifies its geometry up to a polygonal profile in its upper edge, where the sides of the polygonal profile are the junction point between the wall and the flaps; and the overlap of the flaps in closed position forms several sealing points, where one of the vertices of the polygonal profile includes a first cut in one internal flap and a second cut in one external flap, in a manner that when the flaps are closed an opening for pouring is formed enabling the extraction of the liquid from the container.

2. A liquid container according to claim number 1, wherein the wall is joined to the base in a perpendicular manner, where the joint angle is equal or greater than 90°.

3. A liquid container according to claim number 1, wherein the polygonal profile is a rectangular profile.

4. A liquid container according to claim number 1, wherein one of the vertices of the polygonal profile is slightly rounded concurring with the opening for pouring.

5. A liquid container according to claim number 1, wherein the group of flaps includes at least one pair of internal flaps and one pair of external flaps.

6. A liquid container according to claim number 5, wherein the internal flaps close by total or partial overlapping.

7. A liquid container according to claim number 6, wherein the overlapping of the internal flaps is a partial overlap between protruding sections of both flaps, where the configuration of each internal flap includes a first edge joined to the upper edge of the container, where a surface extends toward the center covering half of the mouth of the container, including also in said surface an additional portion with a width equal to half the width of the first edge and enough length to overlap the flaps and keep them in horizontal position.

8. A liquid container according to claim number 5, wherein the external flaps close by total or partial overlapping, where said external flaps also include means to ensure their closed position.

9. A liquid container according to claim number 8, wherein the means ensuring the closed position include a tab that extends from the surface of one of the flaps, with form and size consistent with a slot made in the surface of the opposite flap.

10. A liquid container according to claim number 1, wherein all the flaps include at least one bend that, in their closed position, enables each flap to overlap with the adjacent flaps in their edges joined to the upper edge of the container, and generates a sealing point in each one of the vertices of the polygonal profile.

11. A liquid container according to claim number 10, wherein the bend is located a distance from the edge in a way that keeps the flap in position in the upper part of the container, forming a step between the upper edge of the container and horizontal to the surface of said flap.

12. A liquid container, comprising:

a base;

a wall joined to the base; and several flaps joined to the upper edge of the container in a way that when they close, the mouth of the container, formed by the base and the wall, is covered;

characterized in that the wall joined to the base has a circular profile in its lower edge that modifies its geometry up to a polygonal profile in its upper edge;

it includes a layer of insulation joined to the wall, which in turn includes a sleeve joined with glue to the wall of the container, where the geometry of the sleeve imitates the form of the base's circular profile and additionally is transformed in a polygonal profile as the height of the wall continues upward, forming a parallel layer to the wall of the container, where the edges of the polygonal profile of the sleeve becomes the junction point between the sleeve and the flaps;

the glue, due to its volume and application, generates air gaps between the wall and the sleeve which make up a thermal insulation layer; and the overlap of the flaps in closed position make up several junction points, where one of the vertices of the polygonal profile comprises a first cut in an internal flap and a second cut in an external flap, so that when the flaps are in the closed position an opening for pouring is formed enabling the extraction of liquid from the container.

13. A liquid container according to claim number 12, wherein the wall is joined to the base in a perpendicular way, where the joint angle is equal or greater than 90°.

14. A liquid container according to claim number 12, wherein the polygonal profile is a rectangular profile.

15. A liquid container according to claim number 12, wherein one of the vertices of the polygonal profile is slightly rounded matching with the opening for pouring.

16. A liquid container according to claim number 12, wherein the group of flaps comprises at least one pair of internal flaps and one pair of external flaps.

17. A liquid container according to claim number 16, wherein the internal flaps close by total or partial overlapping.

18. A liquid container according to claim number 17, wherein the overlap of the internal flaps is a partial overlap between protruding sections of both flaps, wherein the configuration of each internal flap comprises a first edge joined to the upper edge of the container, from where the surface extends toward the center covering half of the mouth of the container, including also in said surface an additional portion with a width equal to half the width of the first edge and enough length to enable overlapping the flaps and keep them in horizontal position.

19. A liquid container according to claim number 16, wherein the external flaps close by total or partial overlap, wherein said external flaps also comprise the means to ensure a closed position.

20. A liquid container according to claim number 19, wherein the means that ensure the closed position is comprised of a tab that protrudes from the surface of one on the flaps, with a form and size consistent with the slot made in the surface of the opposite flap.

21. A liquid container according to claim number 12, wherein all flaps are comprised of at least one bend that, in their closed position, enables each flap to overlap with the adjacent flaps in their edges joined to the upper edge of the container, and generates a sealing point in each one of the vertices of the polygonal profile.

22. A liquid container according to claim number 21, wherein the bend is located a distance from the edge, in a way that the flap keeps its position in the upper part of the container, and forms a step between the upper edge of the container and horizontal of the surface of said flap.

* * * * *